US008013730B2

(12) United States Patent
Oh et al.

(10) Patent No.: US 8,013,730 B2
(45) Date of Patent: Sep. 6, 2011

(54) CUSTOMIZATION OF PERSONAL EMERGENCY FEATURES FOR SECURITY SYSTEMS

(75) Inventors: Eric Oh, Syosset, NY (US); David S. Zakrewski, Babylon, NY (US); Shao-Pei Yuan, Great Neck, NY (US)

(73) Assignee: Honeywell International Inc., Morristown, NJ (US)

( * ) Notice: Subject to any disclaimer, the term of this patent is extended or adjusted under 35 U.S.C. 154(b) by 293 days.

(21) Appl. No.: 12/181,581

(22) Filed: Jul. 29, 2008

(65) Prior Publication Data

US 2010/0026481 A1 Feb. 4, 2010

(51) Int. Cl.
*G08B 19/00* (2006.01)

(52) U.S. Cl. ..... 340/521; 340/506; 340/3.1; 340/517

(58) Field of Classification Search ..... 340/521, 340/3.1, 506, 517

See application file for complete search history.

(56) References Cited

U.S. PATENT DOCUMENTS

| | | | | |
|---|---|---|---|---|
| 2,661,394 | A * | 12/1953 | Munch | 379/40 |
| 4,558,181 | A | 12/1985 | Blanchard et al. | |
| 5,086,385 | A * | 2/1992 | Launey et al. | 700/83 |
| 5,337,290 | A * | 8/1994 | Ventimiglia et al. | 368/10 |
| 5,349,338 | A | 9/1994 | Routman et al. | |
| 5,909,480 | A * | 6/1999 | Reynaud et al. | 379/15.01 |
| 6,411,207 | B2 * | 6/2002 | Shaffer | 340/521 |
| 6,442,241 | B1 * | 8/2002 | Tsumpes | 379/45 |
| 6,560,165 | B1 * | 5/2003 | Barker | 368/10 |
| 6,646,676 | B1 * | 11/2003 | DaGraca et al. | 348/155 |
| 6,970,183 | B1 * | 11/2005 | Monroe | 348/143 |
| 7,109,879 | B2 * | 9/2006 | Stults et al. | 340/691.1 |
| 2002/0019886 | A1 * | 2/2002 | Sanghvi et al. | 709/318 |
| 2002/0094072 | A1 * | 7/2002 | Evans et al. | 379/199 |
| 2004/0267385 | A1 * | 12/2004 | Lingemann | 700/83 |
| 2007/0094716 | A1 * | 4/2007 | Farino et al. | 726/5 |
| 2008/0287109 | A1 * | 11/2008 | Marett et al. | 455/414.1 |
| 2008/0300572 | A1 * | 12/2008 | Rankers et al. | 604/504 |
| 2009/0261943 | A1 * | 10/2009 | Jana et al. | 340/3.1 |
| 2010/0026481 | A1 * | 2/2010 | Oh et al. | 340/521 |

* cited by examiner

*Primary Examiner* — Daryl Pope
(74) *Attorney, Agent, or Firm* — Husch Blackwell

(57) ABSTRACT

The inventive system and method comprises a processor operable to detect an event, storage having detailed data corresponding to the event, an input device operable to receive the detailed data, one or more display devices, and an audio output device, wherein when an event is detected, a display is produced on one or more of the display devices and output on the audio output device in accordance with the detailed data corresponding to the event. In one embodiment, the detailed data includes a list of emergency telephone numbers corresponding to the event and an emergency message. In one embodiment, the input device is a graphics keypad that houses the processor, the storage, and at least one of the one or more display devices. The audio output device can be a speaker, and a microphone audio circuit. In one embodiment, the storage has battery backup.

12 Claims, 4 Drawing Sheets

CUSTOMIZATION OF PERSONAL EMERGENCY FEATURES FOR SECURITY SYSTEMS

FIELD OF THE INVENTION

This invention relates generally to security systems. In particular, this invention relates to customizing personal emergency features of security systems.

BACKGROUND OF THE INVENTION

Security systems, or security alarm systems, are used to monitor homes and businesses to prevent unwanted intrusions as well as to guard against natural disasters. The monitoring traditionally includes notifying users when a specific event occurs. A security system can detect natural events such as fire, smoke, and excessive water or humidity, and system conditions such as low battery. Further, man-made events such as intrusions and/or break-ins can be detected. In addition, the detection of an event can occur in response to a user input, such as a keypad input to report a medical emergency.

Any of these events, or others, can trigger a notification from the security system. The technique for notifying users of a triggering event can vary from system to system. Generally, occurrence of an event is indicated by an audio alert, such as an alarm bell or tone. In some situations, text is displayed on a security system screen or panel in addition to the audio alert.

U.S. Pat. No. 7,109,879 to Stults et al., Remotely Activated, Multiple State Alarm System, discloses an alarm system to wake sleeping occupants during a physical emergency situation, such as a fire or intrusion. Using a prerecorded message, the system can wake an occupant and then provide an instructional message to the awakened occupant. However, notification is audio, using voice and sound, with the capability to flash lights but not to display text messages or instructions. Further, no options for individual medical emergencies or scheduled reminders are provided.

U.S. Pat. No. 4,558,181 to Blanchard et al., Portable Device for Monitoring Local Area, and U.S. Pat. No. 6,411,207 to Shaffer, Personal Alert Device, each disclose a portable monitoring device. The device taught by Blanchard et al. requires telephone lines to monitor a selected area, and provides only audio notification via the telephone lines to people in areas remote from the devices. In contrast, Shaffer discloses a personal alert device that provides local user notification; the device is under a user's control and is carried by the user. The device taught by Shaffer does not secure a physical location or area but informs a user of personal physical threats such as tornadoes, fires, etc. However, notification of individual medical emergencies or of scheduled reminders is not provided by either Blanchard et al., or Shaffer.

U.S. Pat. No. 5,349,338 to Routman et al., Fire Detector and Alarm System, discloses a fire alarm system having recorded vocal warning messages and/or instructions. The system enables a user to record a message, including a verbal warning and/or instruction, to be played in the event of a fire. The system does not provide notification of other events, such as intrusions or individual medical emergencies, and does not provide written or visual instructions or messages.

Thus, security systems lack the ability to notify users of individual medical emergencies, and to provide a notification message that includes customized emergency handling information relating directly to the emergency. Such a system would help families better react to emergency situations. Further, security systems lack the ability to notify users of scheduled reminders that would help families better maintain the system and prepare for emergency situations.

SUMMARY OF THE INVENTION

The present invention advantageously provides a novel system and method for reporting activities detected by a security system, including customized personal emergency features. The system comprises a processor operable to detect an event, storage having detailed data corresponding to the event, an input device operable to receive the detailed data, one or more display devices, and an audio output device, wherein when an event is detected, a display is produced on one or more of the display devices and output on the audio output device in accordance with the detailed data corresponding to the event. The event can be a burglary alarm, a panic alarm, a fire alarm, a smoke alarm, a carbon monoxide alarm, an excessive humidity alarm, a medical alarm, and a scheduled reminder. In one embodiment, the detailed data includes a list of emergency telephone numbers corresponding to the event and an emergency message. Each of the display devices can be a status light emitting diode, an icon, a screen, a monitor, and/or a panel for displaying text and graphics. The input device can be a keypad, buttons, a touch screen, and/or a body language motion capture sensor. In one embodiment, the input device is a graphics keypad that houses the processor, the storage, and at least one of the display devices. The input device can be wall-mounted. The audio output device can be a speaker, and/or a microphone audio circuit. In one embodiment, the storage has battery backup and the storage is one of RAM, Flash, ROM, and EEPROM. The security system can detect when the storage battery is low.

BRIEF DESCRIPTION OF THE DRAWING

The invention is further described in the detailed description that follows, by reference to the noted drawings by way of non-limiting illustrative embodiments of the invention, in which like reference numerals represent similar parts throughout the drawings. As should be understood, however, the invention is not limited to the precise arrangements and instrumentalities shown. In the drawings.

The foregoing and other objects, aspects, features, and advantages of the invention will become more apparent from the following description and from the claims.

DISCLOSURE OF THE INVENTION

Figure 1:
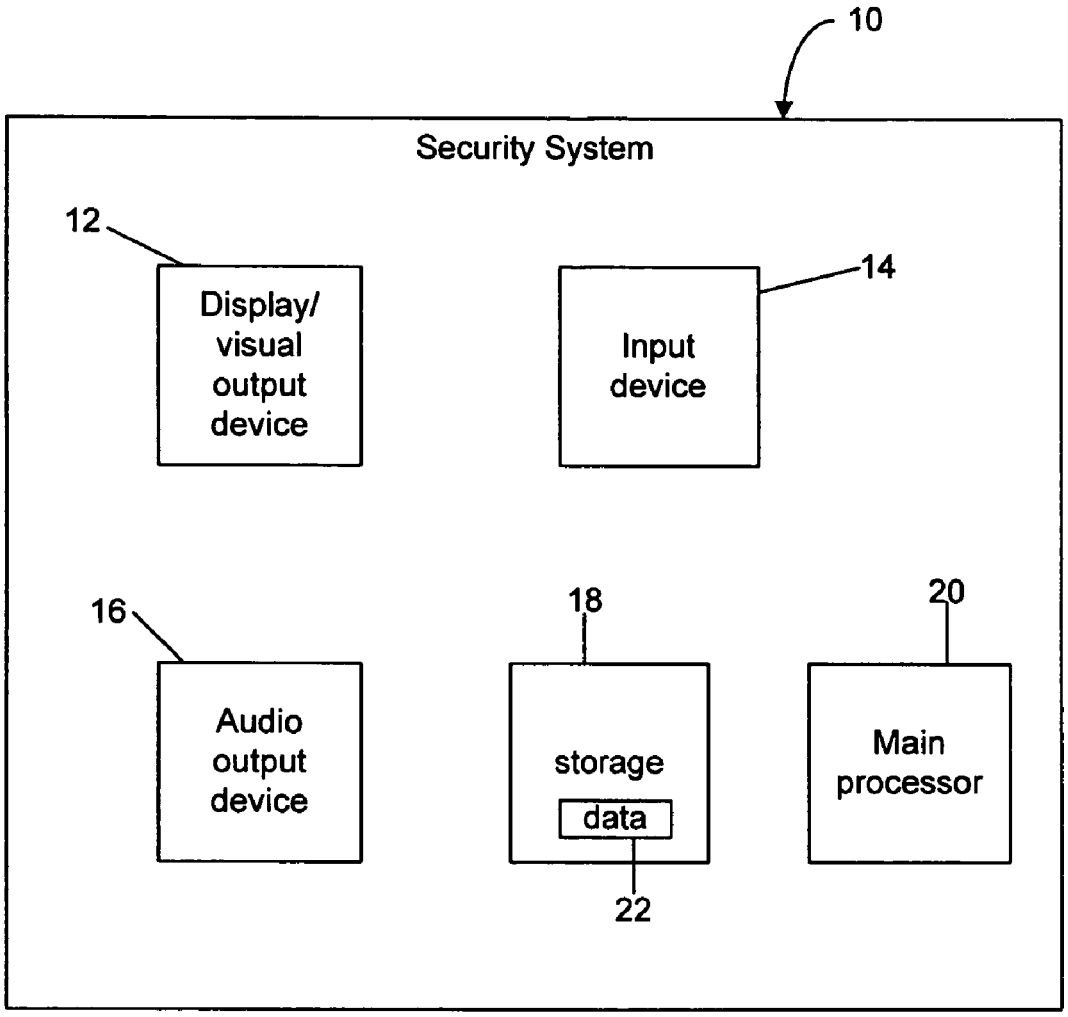
FIG. 1 is a schematic illustration of an exemplary embodiment of the present invention.
Figure 2:
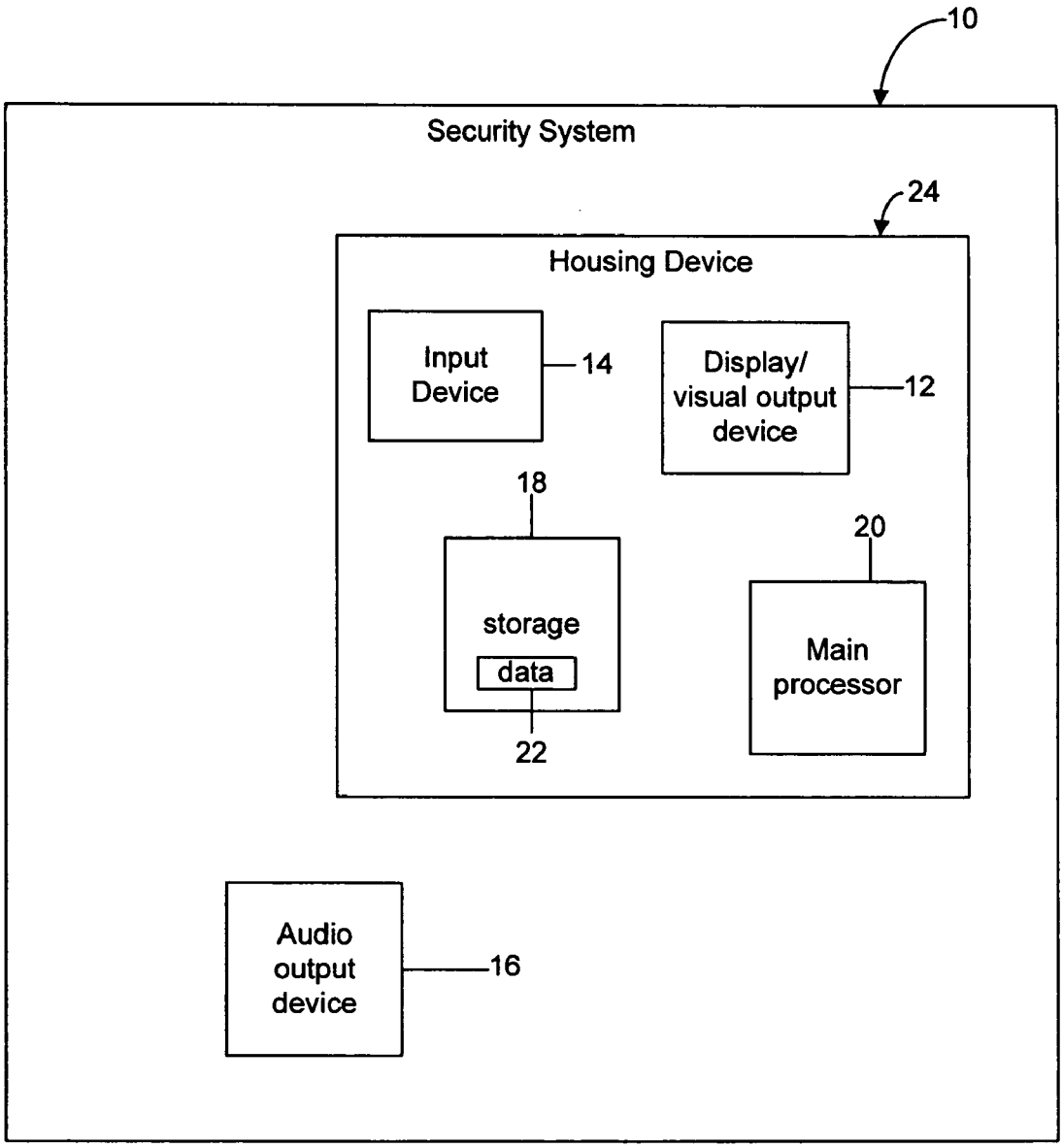
FIG. 2 is a schematic illustration of another exemplary embodiment of the present invention.

An embodiment of the inventive security system 10 is shown in FIG. 1. The system 10 includes zones (not shown), and one or more video output or display devices 12, such as status light emitting diodes (LED), icons, and/or a screen, monitor and/or panel for displaying text and/or graphics. Only one device 12 is shown in FIG. 1 but the system 10 can include any combination of one or more display devices 12. The system 10 also includes an input device 14, such as a keypad, buttons, a touch screen, and/or a body language motion capture sensor, an audio output device 16, such as a speaker and/or microphone audio circuit, non-volatile digital storage 18 for text, graphics and audio, such that the storage device 18 can be, for example, memory having battery backup capability, such as RAM, Flash, ROM, EEPROM, and a main processor 20, as well as other components (not shown), such as heat sensors, motion detectors, etc., to perform the traditional security system functions. The system 10 can include more than one of the components 12, 14, 16, 18, 20; only one of each component is shown for simplicity.

The system 10 also includes instructions and/or procedures for responding to events; these instructions can include detailed data 22 such as emergency notification information, e.g., telephone lists with emergency numbers, and various messages such as resuscitation procedures, allergy warnings, etc. This detailed data 22 corresponds to a specific condition, zone and/or event; for example, there can be detailed data 22 for each medical alarm or medical event or zone, including a separate, personalized list of emergency numbers for each parent and child in the home. Another example of detailed data 22 is information describing items of value to be removed in case of a fire or smoke or excessive humidity alarm.

Not only can medical conditions be treated as zones having detailed data 22, but also physical areas or items, such as a gun cabinet, can be treated as zones with associated detailed data 22. Accordingly, detailed data 22 could provide instructions for actions when a gun cabinet zone, for example, is violated More than one zone and/or condition can have the same detailed data 22. For example, in a structure having two entrances, both can have the same detailed data 22 regarding instructions for responding to an intruder, e.g., "stay inside, call police". Similarly, in a structure having multiple bed rooms, the same detailed data 22 can be associated with more than one bed room, providing instructions, for example, for responding to a fire. Conversely, the same message or detailed data 22 can have more than one trigger. For example, both a scheduled reminder and a low battery sensor can emit the message "please change the batteries". Hence, the detailed data 22 is customized and/or personalized to a zone and/or event, while similar messages can be shared among alarms and/or zones when appropriate.

Typically, a security system has storage 18 including a centralized database in which the detailed data 22 is located; in some situations, for example, the panel does not have storage 18, necessitating the centralized storage of data. In one embodiment, however, a single device 24 can house some of the system 10 components, including the display 12, the input device 14, storage 18, and the main processor 20. The single device 24 can be mounted on a wall (not shown) within a structure being protected by the security system. Other embodiments as known to those skilled in the art are possible, and would not depart from the spirit of the invention. For example, the input device 14 could be a wall-mounted, graphics keypad 26 that also contains the display 12. Such a keypad 26 could also contain storage 18.

The system 10 can respond to a variety of triggering events including burglary or panic alarms, fire, smoke or carbon monoxide alarms, individual medical alarms, and scheduled reminders. A customer or user of the system can provide the appropriate detailed data 22 as well as other configurable information to establish the system's response or notification method for each of the variety of events. Typically, the notification will include a display of pre-programmed text and/or graphics on the display device 12, 26. For example, in response to a fire alarm, the text could include a list of critical items to rescue if these items, and the alarm recipient, are out of harm's way. In response to a medical alarm, instructions specific to the subject who needs medical attention can be provided, along with detailed data 22, such as phone numbers, for anyone viewing the alarm notification to contact. In general, text and/or graphics can provide protected occupants with instructions to be performed based on the triggering event.

In addition to, or instead of, displaying text and/or graphic images, automatic voice responses can be activated by the security system 10 in response to a triggering event or alarm. These user-configurable audio responses emitted by the audio output device 16 can include playback of pre-recorded responses or audio messages, such as a message to intruders and occupants that the system has detected an alarm and dispatched proper authorities, an evacuation procedure for the occupants of the secured structure, and/or medical emergency instructions to anyone near by to help the subject in trouble. Playback of pre-recorded instructions can provide protected occupants with instructions or tasks to be performed based on the triggering event.

The inventive security system 10 enhances a traditional security system with two features to provide customized emergency information and annunciation. First, detailed data 22 is added to the system 10; this detailed data 22 includes, among other things, a listing of user entered emergency phone numbers that are based on the source of the medical alarm, usually associated to a person. A keypad or input device 12 can atomically be triggered to display a list of these emergency phone numbers related to the person who needs attention.

Second, user or customer pre-record and playback of emergency handling procedures is added. These emergency handling procedures can be included in the detailed data 22. For example, a parent can pre-record a voice evacuation procedure for the family. This procedure will be announced manually by the user or atomically when a triggering event, such as a FIRE alarm, is detected by the system 10. Another example would be the medical alarms handling procedure. A pre-recorded voice procedure could be recorded to provide instructions to family members, or others in the vicinity, to care for a stricken member.

Figure 3:
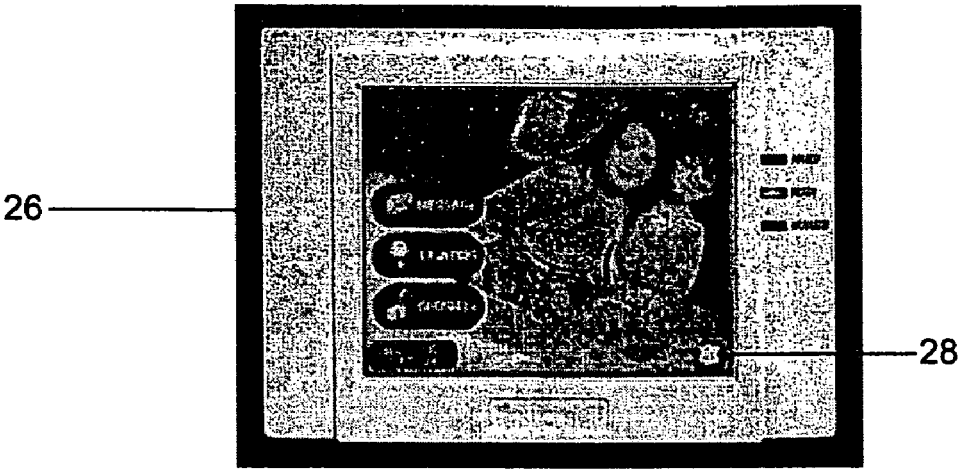
FIG. 3 is an example of a keypad device display in accordance with the present invention.
Figure 4:
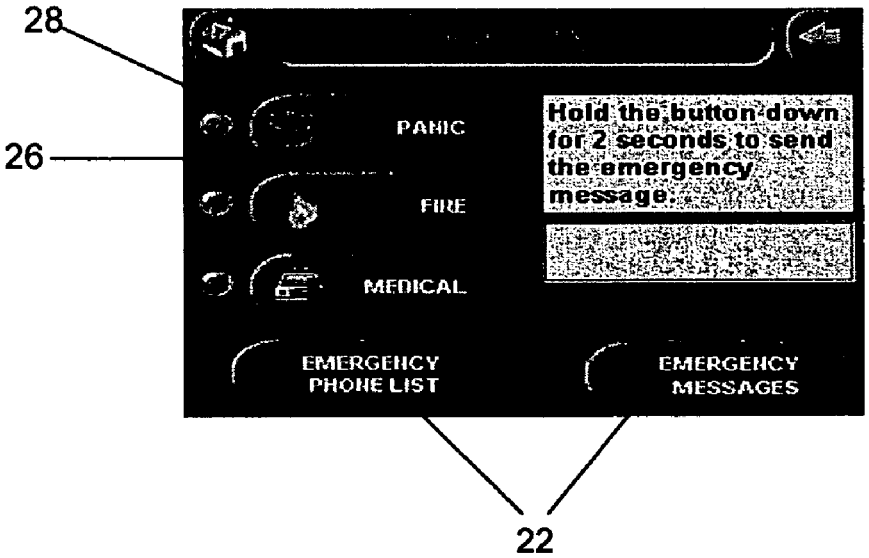
FIG. 4 is an example of the keypad device with another display in accordance with the present invention.

FIGS. 3 and 4 show an example of a wall-mounted, graphic keypad 26, that is, a keypad device that performs both input 14 and output 12 functions. FIG. 3 shows the graphic keypad 26 displaying a screen containing a picture and an emergency or panic button 28. When the user presses this panic button 28, a screen as shown in FIG. 4 is displayed. This screen displays emergency information including the panic button 28 and detailed data 22. When a user presses the detailed data 22 button, the requested information, emergency phone list or emergency messages, is displayed.

The inventive security system 10 also includes scheduled reminders. The system 10 can be preprogrammed internally to trigger a reminder event. It is also possible to have a reminder event triggered by an external service, such as a remote service. In addition, a user action can be required to trigger the reminder event. For example, the system 10 can be internally preprogrammed to remind a home owner to replace all the detector batteries, every nine months. In another example, the remote service, e.g., monitoring company, sends a reminder via the security system 10 to a home owner to pay the monthly alarm monitoring bill three days before the due date.

Figure 5:
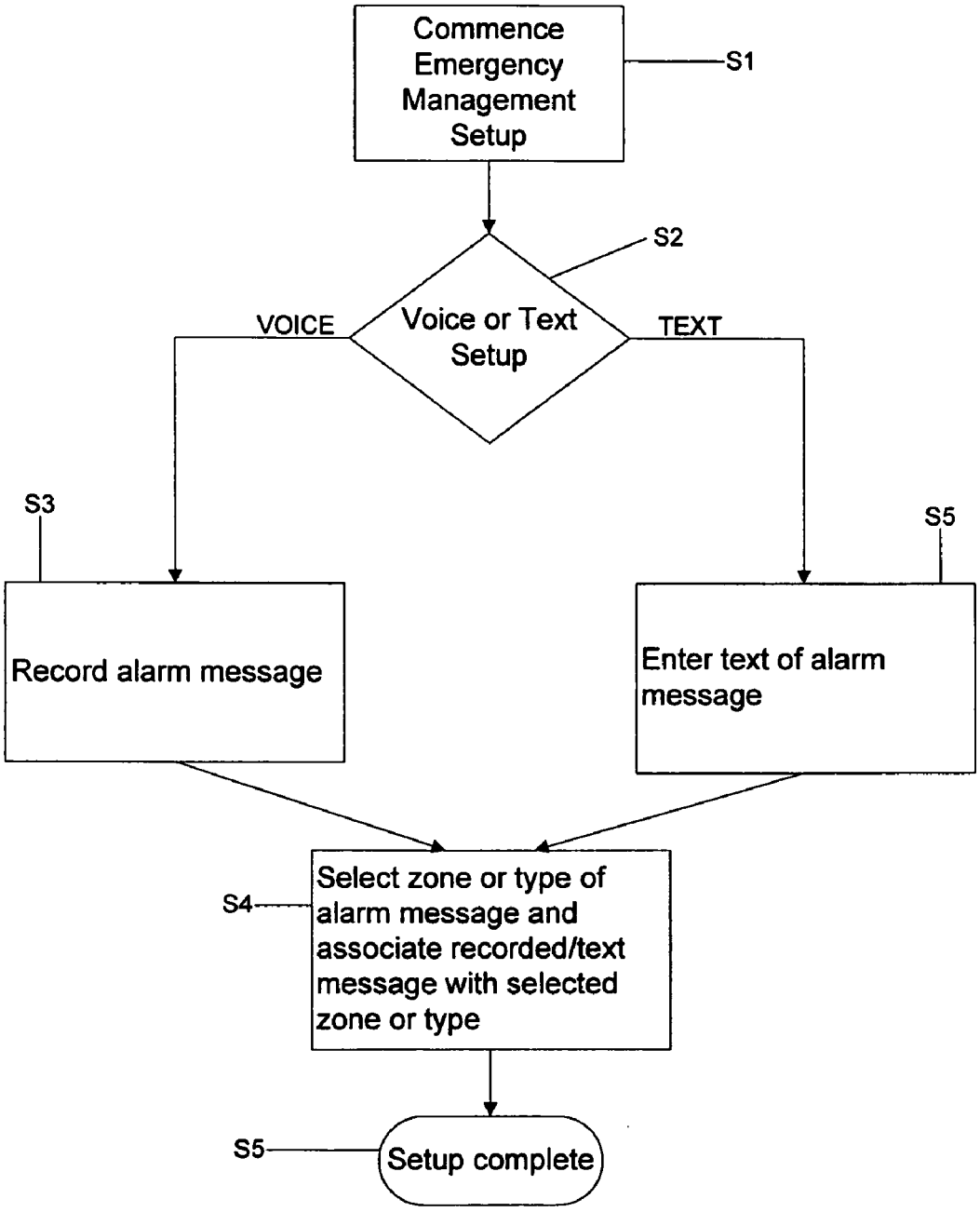
FIG. 5 is a flow diagram of the emergency management setup process in accordance with the present invention.

FIG. 5 shows a flow diagram of the process for inputting of detailed data 22 to the security system 10. Initially, a data entry for alarm messages, or emergency management setup mode, is commenced in step S1. In step S2, a selection is made between voice or text message setup. If voice is selected (S2=voice), the desired alarm message is recorded and stored as detailed data 22 in step S3. The zone or type of alarm message to be recorded is selected in step S4 and the recorded message is associated with this message type or zone. The message type can be for burglar zone alarms, for fire, smoke, CO, or excessive humidity alarms, for medical alarms, and for scheduled reminders. Other message types corresponding to other alarm conditions supported by the system 10 are also permitted. The emergency management setup is completed in step S5.

If text message setup is selected (S2=text), the desired message is entered and stored as detailed data 22 in step S6. Any types of messages supported by the system 10 can be entered as text messages. As with the voice message, the zone or type of alarm message is selected in step S4 and the text message is associated with this alarm message in step S4. The emergency management setup is completed in step S5.

The detailed data 22, which includes the alarm messages created in the emergency management setup as well as customized information and voice annunciation, can be associated to partitions, zones and/or events in the security system 10.

The notification operations of the invention can be implemented as computer software or a computer readable program for operating on a computer. The computer program can be stored on computer readable medium in the non-volatile storage 18.

The embodiments described above are illustrative examples and it should not be construed that the present invention is limited to these particular embodiments. Thus, various changes and modifications may be effected by one skilled in the art without departing from the spirit or scope of the invention as defined in the appended claims.

What is claimed is:

1. A security system comprising:

a processor operable to detect a security, medical, and reminder event;

storage having user-entered detailed data corresponding to the security, medical, and reminder event;

an input device operable to receive the user-entered detailed data, including user pre-recorded handling procedures;

one or more display devices; and an audio output device, wherein when a security, medical, and reminder event is detected, a display in accordance with the user-entered detailed data is produced on one or more of the display devices and the user pre-recorded handling procedures are output on the audio output device.

2. The system according to claim 1, wherein the security event is one of a burglary alarm, a panic alarm, a fire alarm, a smoke alarm, a carbon monoxide alarm, or an excessive humidity alarm, the medical event includes a medical alarm, and the reminder event includes a scheduled reminder.

3. The system according to claim 1, wherein the detailed data includes a list of emergency telephone numbers corresponding to the security, medical, and reminder event and an emergency message.

4. The system according to claim 1, wherein each of the one or more display devices is one of a status light emitting diode, an icon, a screen, a monitor, and a panel for displaying text and graphics.

5. The system according to claim 1, wherein the input device is one of a keypad, buttons, a touch screen, and a body language motion capture sensor.

6. The system according to claim 1, wherein the input device is a graphics keypad and the input device houses the processor, the storage, and at least one of the one or more display devices.

7. The system according to claim 6, wherein the input device is wall-mounted.

8. The system according to claim 1, wherein the audio output device is one of a speaker, and a microphone audio circuit.

9. The system according to claim 1, wherein the storage has battery backup and the storage is one of RAM, Flash, ROM, and EEPROM.

10. A method for reporting activities detected by a security system, comprising steps of:

receiving and storing a plurality of user-entered detailed data, including a plurality of user pre-recorded handling procedures;

detecting a security, medical, and reminder event;

displaying one of the plurality of user-entered detailed data corresponding to the detected security, medical, and reminder event, wherein said one of the plurality of user-entered detailed data comprises at least personal emergency features; and outputting one of the plurality of user pre-recorded handling procedures corresponding to the detected security, medical, and reminder event.

11. The method according to claim 10, wherein the security event is one of a burglary alarm, a panic alarm, a fire alarm, a smoke alarm, a carbon monoxide alarm, or an excessive humidity alarm, the medical event include a medical alarm, and the reminder event includes a scheduled reminder.

12. The method according to claim 10, wherein the detailed data includes a list of emergency telephone numbers corresponding to the security, medical, and reminder event and an emergency message.

* * * * *